US008839847B2

(12) United States Patent
Suzuki et al.

(10) Patent No.: US 8,839,847 B2
(45) Date of Patent: Sep. 23, 2014

(54) CONDENSER

(75) Inventors: Shingo Suzuki, Oyama (JP); Kazumi Tokizaki, Oyama (JP); Yoshihiko Seno, Oyama (JP); Takayuki Fujii, Oyama (JP)

(73) Assignee: Showa Denko K.K., Tokyo (JP)

( * ) Notice: Subject to any disclaimer, the term of this patent is extended or adjusted under 35 U.S.C. 154(b) by 651 days.

(21) Appl. No.: 13/064,697

(22) Filed: Apr. 11, 2011

(65) Prior Publication Data

US 2011/0253352 A1 Oct. 20, 2011

(30) Foreign Application Priority Data

Apr. 16, 2010 (JP) ..... 2010-094800
Mar. 8, 2011 (JP) ..... 2011-049912

(51) Int. Cl.
*F28B 1/00* (2006.01)
*F28F 9/02* (2006.01)
*F28D 1/053* (2006.01)
*F25B 39/04* (2006.01)

(52) U.S. Cl.
CPC ..... *F28D 1/05391* (2013.01); *F28F 9/02* (2013.01); *F28F 9/0243* (2013.01); *F28F 2009/0285* (2013.01); *F25B 2339/044* (2013.01); *F25B 39/04* (2013.01); *F25B 2339/041* (2013.01)
USPC ..... 165/175; 165/67; 165/110

(58) Field of Classification Search
CPC ..... F25B 43/04; F25B 40/00; F25B 40/02; F25B 39/04
USPC ..... 165/67, 110, 173, 175, 176; 62/507, 62/509
See application file for complete search history.

(56) References Cited

U.S. PATENT DOCUMENTS 5,095,972 A * 3/1992 Nakaguro ..... 165/153
5,159,821 A * 11/1992 Nakamura ..... 62/509
5,884,503 A * 3/1999 Inaba ..... 62/509
5,988,267 A * 11/1999 Park et al. ..... 165/110
6,334,333 B1 * 1/2002 Shinhama ..... 62/509

FOREIGN PATENT DOCUMENTS

JP 3-31266 3/1991
JP 11325788 A * 11/1999
JP 2007132631 A * 5/2007

* cited by examiner

*Primary Examiner* — Tho V Duong
(74) *Attorney, Agent, or Firm* — Edwards Wildman Palmer LLP

(57) ABSTRACT

A first header tank to which first heat exchange tubes of third and fourth heat exchange paths are connected and a second header tank to which second heat exchange tubes of first and second heat exchange paths are connected are provided at one end of a condenser. The upper end of the first header tank is located above the lower end of the second header tank. The first header tank has a function of separating gas and liquid from each other and storing the liquid. A spacer is disposed between the first header tank and the second header tank. The spacer includes a first portion which comes into contact with and is brazed to the first header tank, and a second portion which comes into contact with and is brazed to the second header tank.

5 Claims, 7 Drawing Sheets

CONDENSER

CROSS REFERENCE TO RELATED APPLICATIONS

This application claims priority to Japanese Application Nos. 2010-094800 and 2011-049912, filed Apr. 16, 2010 and Mar. 8, 2011, respectively; each of the above-identified applications is incorporated by reference herein. This application is also related to co-pending applications, both entitled, "CONDENSER" filed concurrently herewith in the names of Shingo SUZUKI, Kazumi TOKIZAKI, Yoshihiko SENO and Takayuki FUJII, which claims priority to Japanese Application No. 2010-094804 and 2011-049913, filed Apr. 16, 2010 and Mar. 8, 2011, respectively, and which claims priority to Japanese Application No. 2010-096635 and 2011-059088, filed Apr. 20, 2010 and Mar. 17, 2011, respectively, each of which application is assigned to the assignee of the instant application and which co-pending application is also incorporated by reference herein.

BACKGROUND OF THE INVENTION

The present invention relates to a condenser suitable for use in, for example, a car air conditioner, which is a refrigeration cycle mounted on an automobile.

Herein and in the appended claims, the term "condenser" encompasses not only ordinary condensers but also sub-cool condensers each including a condensation section and a super-cooling section.

Further, herein and in the appended claims, the upper side, lower side, left-hand side, and right-hand side of FIGS. 1 and 2 will be referred to as "upper," "lower," "left," and "right," respectively.

A condenser for a car air conditioner is known (see Japanese Utility Model Application Laid-Open (kokai) No. H3-31266). The known condenser includes a plurality of flat heat exchange tubes which extend in a left-right direction and are disposed in parallel such that their width direction coincides with an air passage direction, and they are spaced apart from one another in a vertical direction; and header tanks which extend in the vertical direction and to which left and right end portions of the heat exchange tubes are connected, respectively. Three heat exchange paths each formed by a plurality of heat exchange tubes successively arranged in the vertical direction are provided such that the three heat exchange paths are juxtaposed in the vertical direction. Refrigerant flows in the same direction through all the heat exchange tubes which form each heat exchange path, and the flow direction of refrigerant flowing through the heat exchange tubes which form one of two adjacent heat exchange paths is opposite the flow direction of refrigerant flowing through the heat exchange tubes which form the other heat exchange path. A first header tank and a second header tank are individually provided at the left end or right end. The heat exchange tubes which form the heat exchange path at the lower end are connected to the first header tank. The heat exchange tubes which form the heat exchange paths other than the lower-end heat exchange path are connected to the second header tank. The second header tank is disposed above the first header tank. The thickness (diameter) of the first header tank is rendered considerably larger than that of the second header tank, and a desiccant is disposed within the first header tank. Thus, the first header tank functions as a liquid receiver which separates gas and liquid from each other by making use of gravitational force and stores the separated liquid. The first heat exchange tubes connected to the first header tank are equal in length to the second heat exchange tubes connected to the second header tank, and the ends of the first heat exchange tubes on the side toward the first header tank and the ends of the second heat exchange tubes on the side toward the second header tank are located on the same vertical line. All the heat exchange paths serve as refrigerant condensation paths for condensing refrigerant.

In the condenser disclosed in the publication, the internal volume of the first header tank must be rendered considerably large as compared with that of the second header tank, in order to effectively perform gas liquid separation within the first header tank. Therefore, the thickness of the first header tank is considerably large as compared with the second header tank, which raises a problem in that a large space is required for installing the condenser.

In general, other devices are disposed in the vicinity of a condenser. In the case of the condenser disclosed in the publication, the first header tank hinders installation of other devices. For example, a radiator is typically disposed downstream (with respect to an air passage direction) of a condenser for a car air conditioner. If the condenser disclosed in the publication is used, the first header tank hinders installation of the radiator. As a result, a wasteful space is produced within an engine compartment, which makes space saving difficult. In addition, since the heat exchange tubes are connected over substantially the entire length of the first header tank, the conventional condenser has a problem in that its gas liquid separation performance is not satisfactory.

SUMMARY OF THE INVENTION

An object of the present invention is to solve the above-mentioned problem and to provide a condenser which can reduce installation space as compared with the condenser disclosed in the above-mentioned publication, and which can suppress corrosion of first and second header tanks.

To achieve the above object, the present invention comprises the following modes.

1) A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which a plurality of heat exchange paths each formed by a plurality of heat exchange tubes successively arranged in the vertical direction are juxtaposed in the vertical direction, wherein first and second header tanks are provided at a left or right end of the condenser, first heat exchange tubes which form at least one heat exchange path located at a lower side being connected to the first header tank, and second heat exchange tubes which form a remaining heat exchange path(s) provided above the heat exchange path formed by the first heat exchange tubes connected to the first header tank being connected to the second header tank;

the first header tank is disposed on the outer side of the second header tank with respect to the left-right direction, has an upper end located above a lower end of the second header tank, and has a function of separating gas and liquid from each other and storing the liquid;

a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank.

2) A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which three or more heat exchange paths each formed by a plurality of heat exchange tubes successively arranged in the vertical direction are juxtaposed in the vertical direction, wherein the condenser has a group composed of at least two heat exchange paths which are successively arranged and which include a heat exchange path at an upper end, and at least one heat exchange path is provided below the group;

in the group, refrigerant is caused to flow from a heat exchange path at one of upper and lower ends toward a heat exchange path at the other end;

first and second header tanks are provided at a left or right end of the condenser, first heat exchange tubes which form a heat exchange path located on the downstreammost side of the group with respect to a refrigerant flow direction and first heat exchange tubes which form the heat exchange path located below the group being connected to the first header tank, and second heat exchange tubes which form all the remaining heat exchange path(s) being connected to the second header tank;

the first header tank is disposed on the outer side of the second header tank with respect to the left-right direction, has an upper end located above a lower end of the second header tank, and has a function of separating gas and liquid from each other and storing the liquid;

a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank.

3) A condenser according to par. 2), wherein, in the group, refrigerant is caused to flow from a heat exchange path at the upper end toward a heat exchange path at the lower end; a lower end of the first header tank is located below the lower end of the second header tank; and the first heat exchange tubes which form the lower end heat exchange path of the group and the heat exchange path provided below the group are connected to a portion of the first header tank located below the second header tank.

4) A condenser according to par. 2), wherein all the heat exchange paths of the group are refrigerant condensation paths for condensing refrigerant, and the heat exchange path located below the group is a refrigerant supper-cooling path for supper-cooling refrigerant.

5) A condenser according to par. 2), wherein the spacer is disposed between the first header tank and a portion of the second header tank excluding a portion to which the second heat exchange tubes of the upstreammost heat exchange path of the group are connected.

6) A condenser according to par. 2), wherein the first heat exchange tubes which form at least two heat exchange paths are connected to the first header tank, and the second heat exchange tubes which form at least one heat exchange path are connected to the second header tank.

7) A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which two or more heat exchange paths each formed by a plurality of heat exchange tubes successively arranged in the vertical direction are juxtaposed in the vertical direction, wherein first and second header tanks are provided at a left or right end of the condenser, first heat exchange tubes which form a heat exchange path at a lower end of the condenser being connected to the first header tank, and second heat exchange tubes which form the heat exchange path(s) other than the heat exchange path at the lower end being connected to the second header tank;

the first header tank is disposed on the outer side of the second header tank with respect to the left-right direction, has an upper end located above a lower end of the second header tank, and has a function of separating gas and liquid from each other and storing the liquid;

a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank.

8) A condenser comprising a plurality of heat exchange tubes disposed in parallel such that the heat exchange tubes are spaced apart from one another in a vertical direction and extend in a left-right direction; header tanks which extend in the vertical direction and to which left and right end portions of the heat exchange tubes are connected; and fins each disposed between and brazed to heat exchange tubes adjacent to each other in the vertical direction, in which two or more heat exchange paths each formed by a plurality of heat exchange tubes successively arranged in the vertical direction are juxtaposed in the vertical direction, wherein first and second header tanks are provided at a left or right end of the condenser, first heat exchange tubes which form a heat exchange path at an upper end of the condenser being connected to the first header tank, and second heat exchange tubes which form the heat exchange path(s) other than the heat exchange path at the upper end being connected to the second header tank;

the first header tank is disposed on the outer side of the second header tank with respect to the left-right direction, has a lower end located below an upper end of the second header tank, and has a function of separating gas and liquid from each other and storing the liquid;

a spacer is disposed between the second header tank and a portion of the first header tank projecting downward beyond the upper end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank.

9) A condenser according to par. 7) or 8), wherein each of all the heat exchange paths serves as a refrigerant condensation path for condensing refrigerant.

10) A condenser according to par. 1), 2), 7), or 8), wherein a clearance between the second header tank and a portion of the first header tank projecting beyond the second header thank has a width of 2 mm or greater.

According to the condenser of par. 1), first and second header tanks are provided at the left or right end of the condenser. First heat exchange tubes which form at least one heat exchange path located at a lower side are connected to the first header tank. Second heat exchange tubes which form a remaining heat exchange path(s) provided above the heat exchange path formed by the first heat exchange tubes connected to the first header tank are connected to the second header tank. The first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

Furthermore, a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank. Therefore, at the time of manufacture of the condenser, positioning of members which constitute the first and second header tanks can be performed simply.

Moreover, a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank. By means of the spacer, the width of the clearance between the second header tank and a portion of the first header tank projecting upward beyond the lower end of the second header tank can be maintained at a proper size which can suppress accumulation of a substance which accelerates corrosion, whereby corrosion of the first and second header tanks can be suppressed. That is, if the width of the clearance between the second header tank and a portion of the first header tank projecting upward beyond the lower end of the second header tank is smaller than a proper size, the corrosion accelerating substance having entered the clearance becomes unlikely to be discharged from the clearance and becomes like to accumulate there, to thereby accelerate corrosion of the first and second header tanks. In contrast, in the case where, by means of the spacer, the width of the clearance between the second header tank and a portion of the first header tank projecting upward beyond the lower end of the second header tank is maintained at a proper size which can suppress accumulation of a substance which accelerates corrosion, the corrosion accelerating substance having entered the clearance can be discharged efficiently, whereby corrosion of the first and second header tanks can be suppressed.

According to the condensers of par. 2) to 6), first and second header tanks are provided at the left or right end of the condenser. First heat exchange tubes which form a heat exchange path located on the downstreammost side of the group with respect to a refrigerant flow direction and first heat exchange tubes which form the heat exchange path located below the group are connected to the first header tank. Second heat exchange tubes which form all the remaining heat exchange path(s) are connected to the second header tank. The first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

Furthermore, a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank. Therefore, at the time of manufacture of the condenser, positioning of members which constitute the first and second header tanks can be performed simply.

Moreover, a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank. By means of the spacer, the width of the clearance between the second header tank and a portion of the first header tank projecting upward beyond the lower end of the second header tank can be maintained at a proper size which can suppress accumulation of a substance which accelerates corrosion, whereby corrosion of the first and second header tanks can be suppressed. That is, if the width of the clearance between the second header tank and a portion of the first header tank projecting upward beyond the lower end of the second header tank is smaller than a proper size, the corrosion accelerating substance having entered the clearance becomes unlikely to be discharged from the clearance and becomes like to accumulate there, to thereby accelerate corrosion of the first and second header tanks. In contrast, in the case where, by means of the spacer, the width of the clearance between the second header tank and a portion of the first header tank projecting upward beyond the lower end of the second header tank is maintained at a proper size which can suppress accumulation of a substance which accelerates corrosion, the corrosion accelerating substance having entered the clearance can be discharged efficiently, whereby corrosion of the first and second header tanks can be suppressed.

According to the condenser of par. 4), refrigerant flows into the first header tank from a plurality of heat exchange tubes which form the refrigerant condensation path located on the downstreammost side of the group, and gas liquid separation is performed within the first header tank. Therefore, the gas liquid separation can be performed efficiently within the first header tank. That is, gas-liquid mixed phase refrigerant whose gas phase component is large in amount flows through upper-side first heat exchange tubes among a plurality of first heat exchange tubes which form a refrigerant condensation path, and gas-liquid mixed phase refrigerant whose liquid phase component is large in amount flows through lower-side first heat exchange tubes among the plurality of first heat exchange tubes. Since these gas-liquid mixed phase refrigerants flow into the first header tank without mixing, gas liquid separation can be performed efficiently.

According to the condenser of par. 5), heat of relatively hot refrigerant having flowed from the second heat exchange tubes of the upstreammost side heat exchange path of the group into the second header tank is prevented from being transmitted to refrigerant within the first header tank via the spacer. Accordingly, overheating of refrigerant within the first header tank, which has a function of separating gas and liquid from each other and storing the liquid, is prevented, and a stable region in which the degree of supper-cooling becomes constant can be expanded. Thus, there can be obtained a super-cooling characteristic necessary for following dynamic factors such as variation of external air and interval variation of a car air conditioner in which the condenser is used.

According to the condenser of par. 7), first and second header tanks are provided at a left or right end of the condenser, first heat exchange tubes which form a heat exchange path at a lower end of the condenser being connected to the first header tank, and second heat exchange tubes which form the heat exchange path(s) other than the lower-end heat exchange path being connected to the second header tank; and the first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

Further, refrigerant flows into the first header tank from a plurality of first heat exchange tubes which form the heat exchange path located at the lower end, and gas liquid separation is performed within the first header tank. Therefore, the gas liquid separation can be performed efficiently within the first header tank. That is, gas-liquid mixed phase refrigerant whose gas phase component is large in amount flows through upper-side first heat exchange tubes among a plurality of first heat exchange tubes which form the lower-end heat exchange path, and gas-liquid mixed phase refrigerant whose liquid phase component is large in amount flows through lower-side first heat exchange tubes among the plurality of first heat exchange tubes. Since these gas-liquid mixed phase refrigerants flow into the first header tank without mixing, gas liquid separation can be performed efficiently.

Furthermore, a spacer is disposed between the second header tank and a portion of the first header tank projecting upward beyond the lower end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank. Therefore, as in the case of the condenser of par. 1), at the time of manufacture of the condenser, positioning of members which constitute the first and second header tanks can be performed simply. In addition, corrosion of the first and second header tanks can be suppressed.

According to the condenser of par. 8), first and second header tanks are provided at a left or right end of the condenser, first heat exchange tubes which form a heat exchange path at an upper end of the condenser being connected to the first header tank, and second heat exchange tubes which form the heat exchange path(s) other than the upper-end heat exchange path being connected to the second header tank; the first header tank is disposed on the outer side of the second header tank with respect to the left-right direction, has a lower end located below an upper end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the lower end of the first header tank downward to the vicinity of the lower end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

Further, refrigerant flows into the first header tank from a plurality of heat exchange tubes which form the heat exchange path located at the upper end, and gas liquid separation is performed within the first header tank. Therefore, the gas liquid separation can be performed efficiently within the first header tank. That is, gas-liquid mixed phase refrigerant whose gas phase component is large in amount flows through upper-side first heat exchange tubes among a plurality of first heat exchange tubes which form the upper-end heat exchange path, and gas-liquid mixed phase refrigerant whose liquid phase component is large in amount flows through lower-side first heat exchange tubes among the plurality of first heat exchange tubes. Since these gas-liquid mixed phase refrigerants flow into the first header tank without mixing, gas liquid separation can be performed efficiently.

Furthermore, a spacer is disposed between the second header tank and a portion of the first header tank projecting downward beyond the upper end of the second header thank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank. Therefore, as in the case of the condenser of par. 1), at the time of manufacture of the condenser, positioning of members which constitute the first and second header tanks can be performed simply. In addition, corrosion of the first and second header tanks can be suppressed.

According to the condenser of par. 10), it becomes possible to effectively suppress accumulation of a corrosion accelerating substance in the clearance between the second header tank and a portion of the first header tank projecting from the second header tank.

DESCRIPTION OF THE PREFERRED EMBODIMENTS

Embodiments of the present invention will next be described with reference to the drawings.

Figure 1:
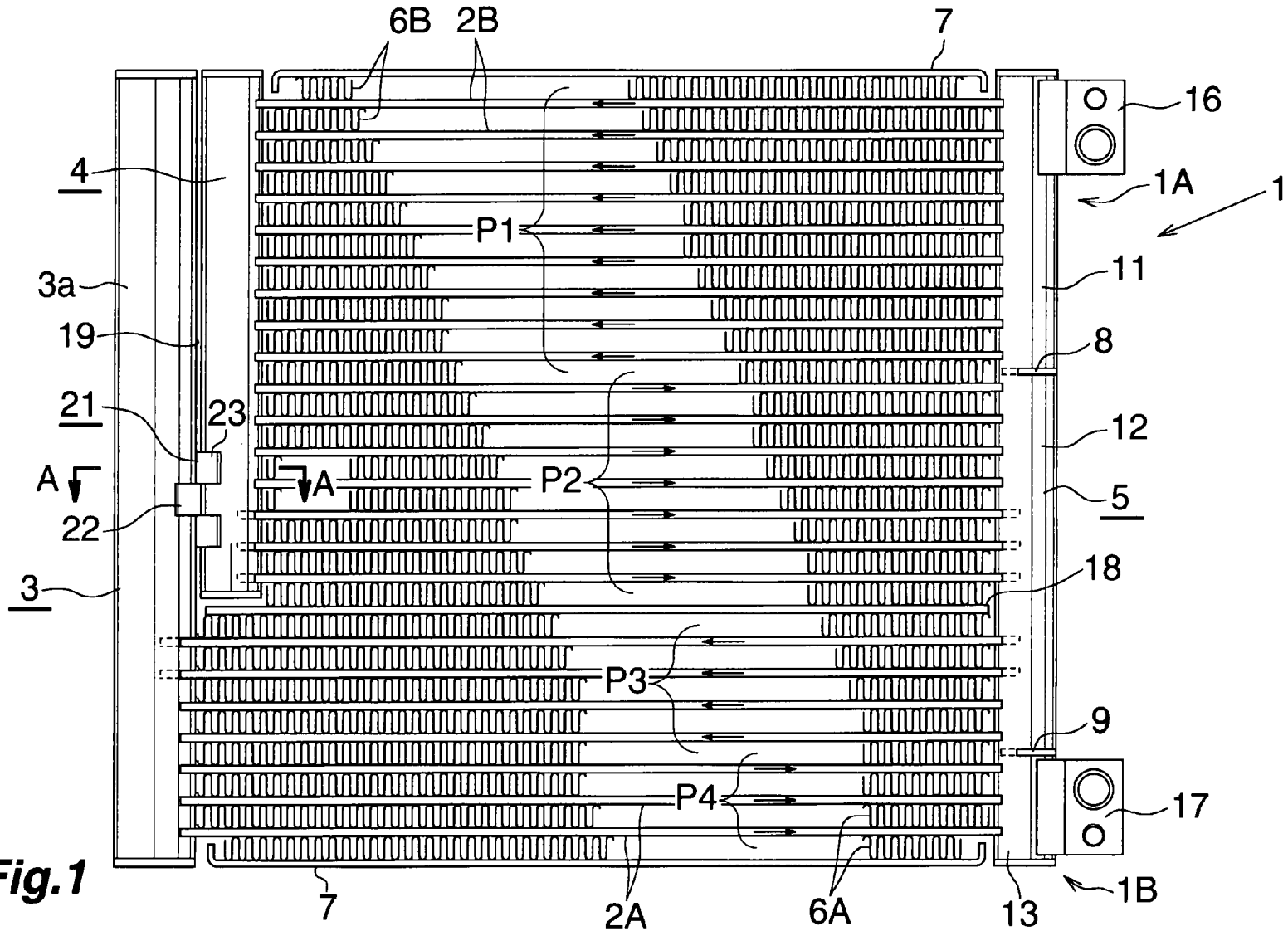
FIG. 1 is a front view specifically showing the overall structure of a first embodiment of the condenser according to the present invention.

In the following description, the downstream side with respect to an air passage direction (the reverse side of a sheet on which FIG. 1 is drawn; the upper side in FIG. 3) will be referred to as the "front," and the opposite side as the "rear."

Furthermore, the term "aluminum" as used in the following description encompasses aluminum alloys in addition to pure aluminum.

Moreover, the same reference numerals are used throughout the drawings to refer to the same portions and members, and their repeated descriptions are omitted.

Figure 2:
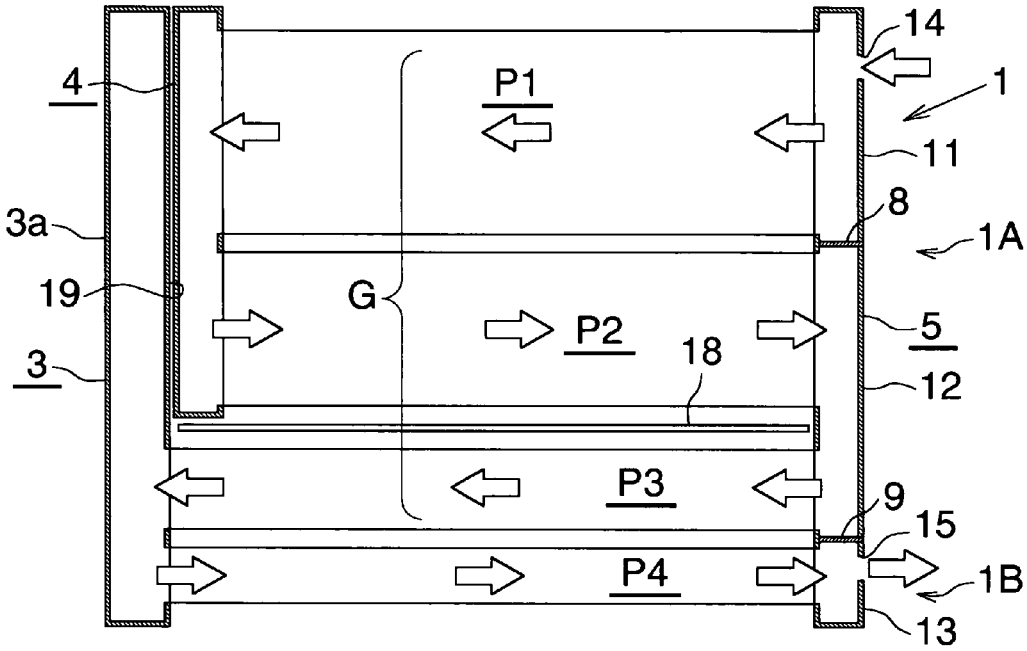
FIG. 2 is a front view schematically showing the condenser of FIG. 1.
Figure 3:
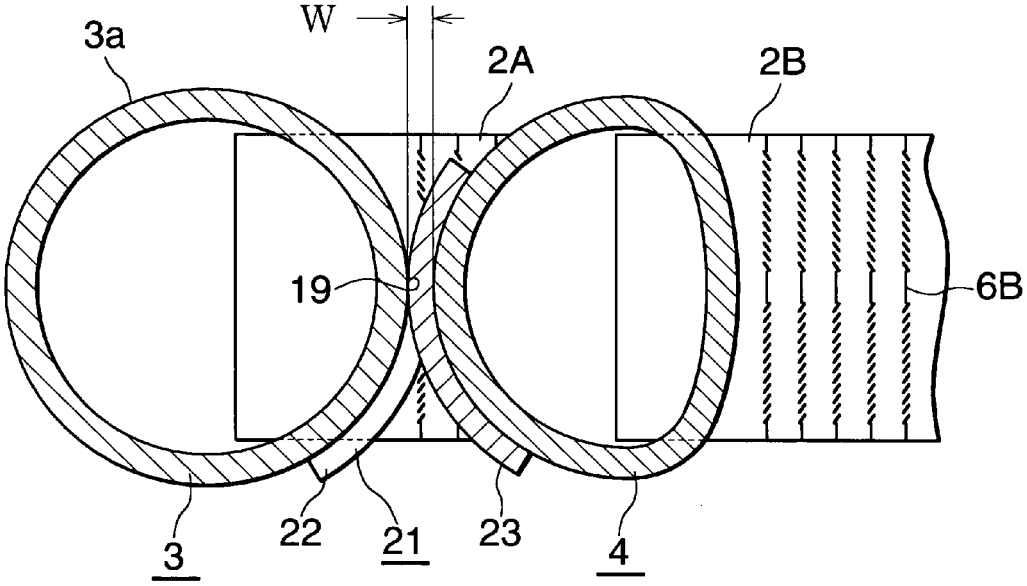
FIG. 3 is an enlarged sectional view taken along line A-A of FIG. 1.
Figure 4:
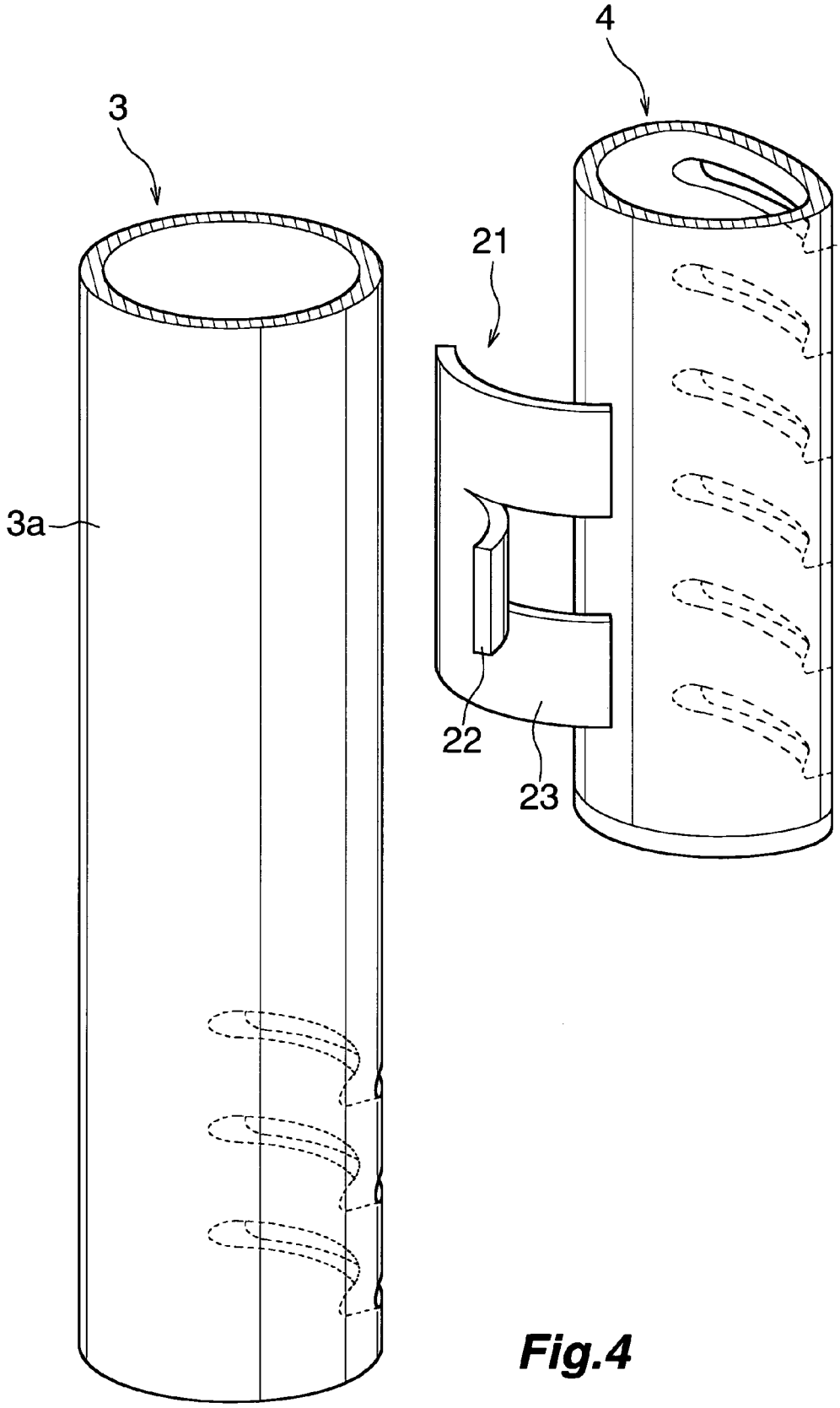
FIG. 4 is an exploded perspective view showing a portion of a first header tank, a portion of a second header thank, and a spacer of the condenser of FIG. 1.

FIG. 1 specifically shows the overall structure of a first embodiment of the condenser according to the present invention; and FIG. 2 schematically shows the condenser of FIG. 1. In FIG. 2, individual heat exchange tubes are omitted, and corrugate fins, side plates, a refrigerant inlet member, and a refrigerant outlet member are also omitted. FIGS. 3 and 4 show the structure of a main portion of the condenser of FIG. 1.

In FIGS. 1 and 2, a condenser 1 includes a plurality of flat heat exchange tubes 2A, 2B formed of aluminum, three header tanks 3, 4, 5 formed of aluminum, corrugate fins 6A, 6B formed of aluminum, and side plates 7 formed of aluminum. The heat exchange tubes 2A, 2B are disposed such that their width direction coincides with a front-rear direction, their length direction coincides with a left-right direction, and they are spaced from one another in a vertical direction. Left and right end portions of the heat exchange tubes 2A, 2B are connected, by means of brazing, to the header tanks 3, 4, 5, which extend in the vertical direction. Each of the corrugate fins 6A, 6B is disposed between and brazed to adjacent heat exchange tubes 2A, 2B, or is disposed on the outer side of the uppermost or lowermost heat exchange tube 2A, 2B and brazed to the corresponding heat exchange tube 2A, 2B. The side plates 7 are disposed on the corresponding outer sides of the uppermost and lowermost corrugate fins 6A, 6B, and are brazed to these corrugate fins 6A, 6B. Three or more heat exchange paths (in the present embodiment, four heat exchange paths P1, P2, P3, P4) each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

That is, the condenser 1 includes a group G composed of at least two heat exchange paths which are successively arranged and which include the first heat exchange path P1 at the upper end (in the present embodiment, the first through third heat exchange paths P1, P2, P3), and at least one heat exchange path (in the present embodiment, the fourth heat exchange path P4) is provided below the group G. In the group G, refrigerant flows from the first heat exchange path P1 at the upper end toward the third heat exchange path P3 at the lower end.

A first header tank 3 and a second header tank 4 are individually provided at the left end of the condenser 1. The heat exchange tubes 2A, which form the lower end heat exchange path located on the downstreammost side of the group G with respect to the refrigerant flow direction, and the heat exchange path located below the group G (in the present embodiment, the third and fourth heat exchange paths P3, P4), are connected to the first header tank 3 by means of brazing. The heat exchange tubes 2B, which form all the remaining heat exchange paths (in the present embodiment, the first and second heat exchange paths P1, P2), are connected to the second header tank 4 by means of brazing. Notably, the lower end of the first header tank 3 is located below the lower end of the second header tank 4, and the heat exchange tubes 2A, which form the third and fourth heat exchange paths P3, P4 are brazed to a portion of the first header tank 3 located below the second header tank 4. The upper end of the first header tank 3 and the upper end of the second header tank 4 are located at substantially the same height.

The heat exchange tubes 2A connected to the first header tank 3 will be referred to as the first heat exchange tubes, and the heat exchange tubes 2B connected to the second header tank 4 will be referred to as the second heat exchange tubes. The corrugate fins 6A disposed between the adjacent first heat exchange tubes 2A and between the lower-end first heat exchange tube 2A and the lower side plate 7 will be referred to as the first corrugate fins. The corrugate fins 6B disposed between the adjacent second heat exchange tubes 2B, between the upper-end first heat exchange tube 2A and the lower-end second heat exchange tube 2B, and between the upper-end second heat exchange tube 2B and the upper side plate 7 will be referred to as the second corrugate fins.

Although the first header tank 3 and the second header tank 4 are approximately equal to each other in terms of the dimension along the front-rear direction, the first header tank 3 is greater than the second header tank 4 in terms of the horizontal cross sectional area. The first header tank 3 is disposed on the left side (on the outer side with respect to the left-right direction) of the second header tank 4. The center of the first header tank 3 with respect to the left-right direction is located on the outer side (with respect to the left-right direction) of the center of the second header tank 4 with respect to the left-right direction. Therefore, the first header tank 3 and the second header tank 4 are offset from each other such that they do not overlap as viewed from above. The upper end of the first header tank 3 is located above the lower end of the second header tank 4. In the present embodiment, the upper end of the first header tank 3 is located at a position which is substantially the same height as the upper end of the second header tank 4. Thus, the first header tank 3 serves as a liquid receiver which separates gas and liquid from each other through utilization of gravitational force, and stores the separated liquid. That is, the internal volume of the first header tank 3 is determined such that a portion of gas-liquid mixed phase refrigerant having flowed into the first header tank 3; i.e., liquid-predominant mixed phase refrigerant, remains in a lower region within the first header tank 3 because of gravitational force, and the gas phase component of the gas-liquid mixed phase refrigerant remains in an upper region within the first header tank 3 because of gravitational force, whereby only the liquid-predominant mixed phase refrigerant flows into the first heat exchange tubes 2A of the fourth heat exchange path P4.

The third header tank 5 is disposed at the right end of the condenser 1, and all the heat exchange tubes 2A, 2B which form the first to fourth heat exchange paths P1-P4 are connected to the third header tank 5. The transverse cross sectional shape of the third header tank 5 is identical with that of the second header tank 4. The interior of the third header tank 5 is divided into an upper header section 11, an intermediate header section 12, and a lower header section 13 by aluminum partition plates 8, 9, which are provided at a height between the first heat exchange path P1 and the second heat exchange path P2 and a height between the third heat exchange path P3 and the fourth heat exchange path P4, respectively. Left end portions of the second heat exchange tubes 2B of the first heat exchange path P1 are connected to the second header tank 4, and right end portions thereof are connected to the upper header section 11 of the third header tank 5. Left end portions of the second heat exchange tubes 2B of the second heat exchange path P2 are connected to the second header tank 4, and right end portions thereof are connected to the intermediate header section 12 of the third header tank 5. Left end portions of the first heat exchange tubes 2A of the third heat exchange path P3 are connected to the first header tank 3, and right end portions thereof are connected to the intermediate header section 12 of the third header tank 5. Left end portions of the first heat exchange tubes 2A of the fourth heat exchange path P4 are connected to the first header tank 3, and right end portions thereof are connected to the lower header section 13 of the third header tank 5.

The second header tank 4, a portion of the first header tank 3 to which the first heat exchange tubes 2A of the third heat exchange path P3 are connected, the upper and intermediate header sections 11 and 12 of the third header tank 5, and the first to third heat exchange paths P1-P3 form a condensation section 1A, which condenses refrigerant. A portion of the first header tank 3 to which the first heat exchange tubes 2A of the fourth heat exchange path P4 are connected, the lower header section 13 of the third header tank 5, and the fourth heat exchange path P4 form a super-cooling section 1B, which super-cools refrigerant. Each of the first to third heat exchange paths P1-P3, which are all the heat exchange paths of the group G, serves as a refrigerant condensation path for condensing refrigerant, and the fourth heat exchange path P4, which is located below the group G, serves as a refrigerant super-cooling path for super-cooling refrigerant.

A refrigerant inlet 14 is formed at the upper header section 11 of the third header tank 5, which partially forms the condensation section 1A, and a refrigerant outlet 15 is formed at the lower header section 13 of the third header tank 5, which partially forms the super-cooling section 1B. A refrigerant inlet member 16 which communicates with the refrigerant inlet 14 and a refrigerant outlet member 17 which communicates with the refrigerant outlet 15 are joined to the third header tank 5.

An intermediate member 18 formed of aluminum and extending in the left-right direction is disposed between the upper-end first heat exchange tube 2A of the third heat exchange path P3 and the lower-end second heat exchange tube 2B of the second heat exchange path P2 such that the intermediate member 18 is separated from these heat exchange tubes 2A, 2B, and becomes substantially parallel to the heat exchange tubes 2A, 2B. A first corrugate fin 6A is disposed between the upper-end first heat exchange tube 2A of the third heat exchange path P3 and the intermediate member 18, and is brazed to the first heat exchange tube 2A and the intermediate member 18. A second corrugate fin 6B is disposed between the lower-end second heat exchange tube 2B of the second exchange path P2 and the intermediate member 18, and is brazed to the second heat exchange tube 2B and the intermediate member 18. Left and right end portions of the intermediate member 18 are located near the first header tank 3 and the third header tank 5, respectively, and are not inserted into the first header tank 3 and the third header tank 5. A tube having the same configuration as that of the second heat exchange tubes 2B is used as the intermediate member 18. Since opposite end portions of the intermediate member 18 are not inserted into the first header tank 3 and the third header tank 5, use of a tube having the same configuration as that of the second heat exchange tubes 2B becomes possible.

As shown in FIGS. 3 and 4, a spacer 21 formed of aluminum is disposed between a projecting portion 3*a* of the first header tank 3 which projects upward beyond the lower end of the second header tank 4 and a portion of the second header tank 4 to which the second heat exchange tubes 2B of the second heat exchange path P2 is connected; i.e., a portion of the second header tank 4 excluding a portion to which the second heat exchange tubes 2B of the first heat exchange path P1, which is the upstreammost heat exchange path of the group G, are connected. The spacer 21 is composed of a first portion 22 which comes into contact with a portion of the outer circumferential surface of the first header tank 3 and is brazed to the first header tank 3, and two second portions 23 which are provided on upper and lower sides of the first portion 22, come into contact with portions of the outer circumferential surface of the second header tank 4, and are brazed to the second header tank 4. By means of the spacer 21, the width of the clearance 19 between the projecting portion 3*a* of the first header tank 3 and the second header tank 4 is maintained at a proper size which can suppress accumulation of a substance which accelerates corrosion. Preferably, the width W of the clearance 19 as measured in the left-right direction is 2 mm or greater. The upper limit of the width W of the clearance 19 as measured in the left-right direction is determined such that the entire width of the condenser 1 as measured in the left-right direction does not become excessively large. The spacer 21 is formed through a process of forming two slits in an aluminum plate from one side edge thereof, and bending a portion between the slits and portions on the outer sides of the slits (i.e., portions located on opposite sides of each slit) to thereby form the first portion 22 and the second portions 23. Notably, the number of the first and second portions 22, 23 of the spacer 21 is not limited to the number shown in the drawings, and the number of slits cut for formation of the spacer 21 is changed in accordance with the number of the first and second portions 22, 23.

The condenser 1 is manufactured by brazing all the components together. During manufacture of the condenser 1, all the components to be brazed together are assembled provisionally. At the time of the provisional assembly, the first portion 22 of the spacer 21 is partially welded, by a proper method, to a member which constitutes the first header tank 3, and the second portions 23 of the spacer 21 are partially welded, by a proper method, to a member which constitutes the second header tank 4, whereby positioning of the members which constitute the first header tank 3 and the second header tank 4 is completed. However, the above-described partial welding is not necessarily required.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the upper header section 11 of the third header tank 5 via the refrigerant inlet member 16 and the refrigerant inlet 14. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the intermediate header section 12 of the third header tank 5. The refrigerant having flowed into the intermediate header section 12 of the third header tank 5 is condensed while flowing leftward within the first heat exchange tubes 2A of the third heat exchange path P3, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the fourth heat exchange path P4.

The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 13 of the third header tank 5, and flows out via the refrigerant outlet 15 and the refrigerant outlet member 17. The refrigerant is then fed to the evaporator via the expansion valve.

Meanwhile, the gas phase component of the gas-liquid mixed phase refrigerant having flowed into the first header tank 3 remains in an upper region within the first header tank 3.

FIGS. 5 to 8 show other embodiments of the condenser of the present invention.

Figure 5:
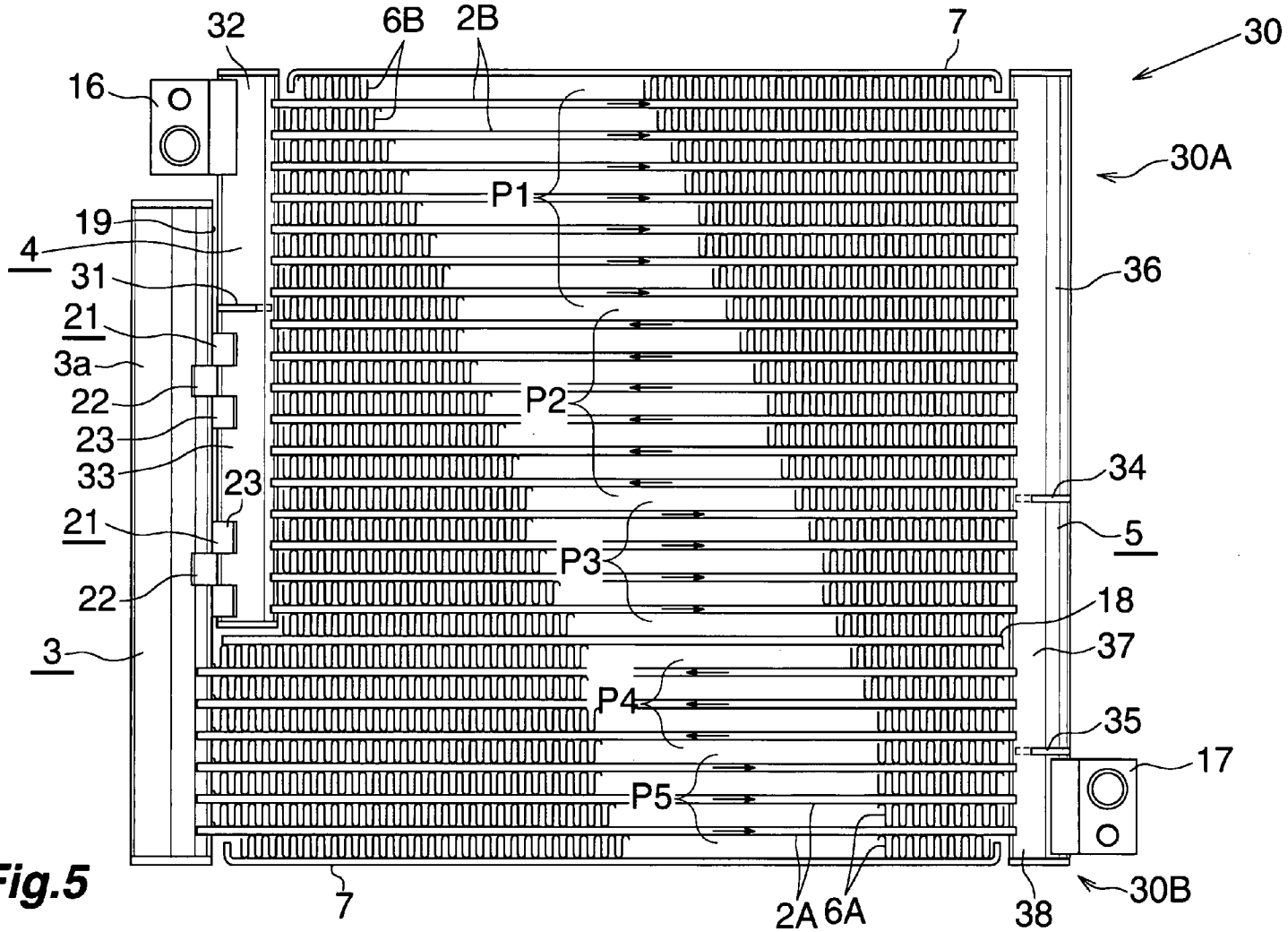
FIG. 5 is a front view specifically showing the overall structure of a second embodiment of the condenser according to the present invention.
Figure 6:
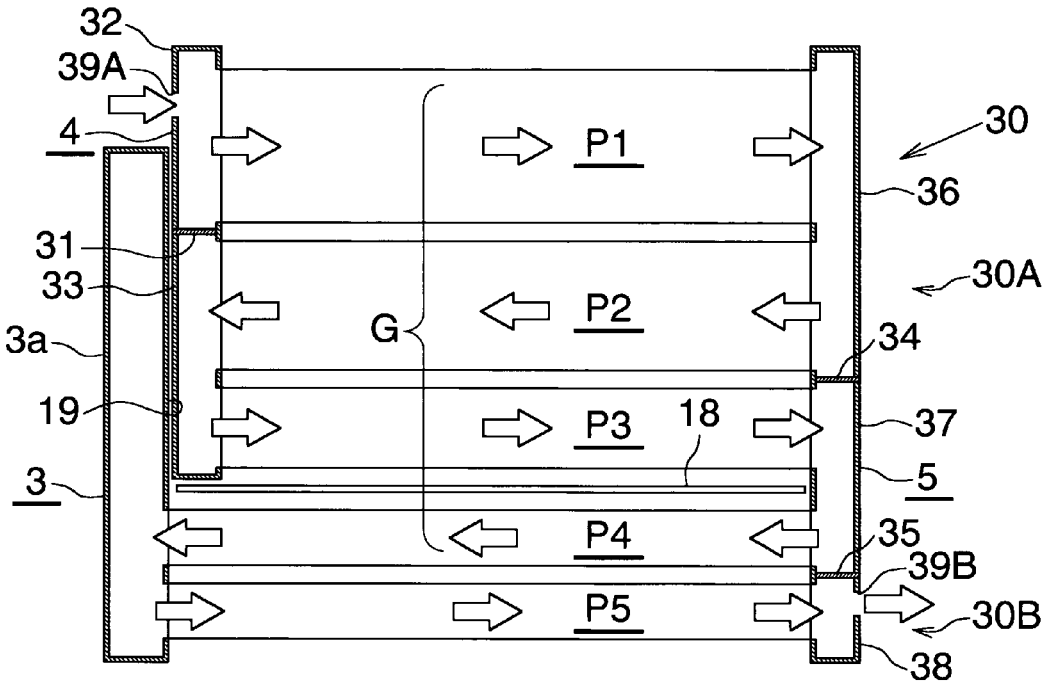
FIG. 6 is a front view schematically showing the condenser of FIG. 5.

FIG. 5 specifically shows the overall structure of a second embodiment of the condenser according to the present invention; and FIG. 6 schematically shows the condenser of FIG. 5. In FIG. 6, the individual heat exchange tubes are omitted, and the corrugate fins, the side plates, the refrigerant inlet member, and the refrigerant outlet member are also omitted.

In the case of a condenser 30 shown in FIGS. 5 and 6, five heat exchange paths P1, P2, P3, P4, P5 each formed by a plurality of heat exchange tubes 2A, 2B successively arranged in the vertical direction are juxtaposed in the vertical direction. The five heat exchange paths will be referred to as the first to fifth heat exchange paths P1, P2, P3, P4, P5 from the upper side. The flow direction of refrigerant is the same among all the heat exchange tubes 2A, 2B which form the respective heat exchange paths P1, P2, P3, P4, P5. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

That is, the condenser 30 includes a group G composed of at least two heat exchange paths which are successively arranged and which include the first heat exchange path P1 at the upper end (in the present embodiment, the first through fourth heat exchange paths P1, P2, P3, P4), and at least one heat exchange path (in the present embodiment, the fifth heat exchange path P5) is provided below the group G. In the group G, refrigerant flows from the first heat exchange path P1 at the upper end toward the fourth heat exchange path P4 at the lower end.

Left and right end portions of the heat exchange tubes 2A, which form the lower end heat exchange path located on the downstreammost side of the group G with respect to the refrigerant flow direction, and the heat exchange path located below the group G (in the present embodiment, the fourth and fifth heat exchange paths P4, P5), are connected to the first header tank 3 and the third header tank 5, respectively, by means of brazing. Left and right end portions of the heat exchange tubes 2B, which form all the remaining heat exchange paths (in the present embodiment, the first through third second heat exchange paths P1, P2, P3), are connected to the second header tank 4 and the third header tank 5, respectively, by means of brazing. Therefore, the heat exchange tubes 2A, which form the fourth and fifth heat exchange paths P4, P5 are the first heat exchange tubes, and the heat exchange tubes 2B, which form the first through third heat exchange paths P1, P2, P3, are the second heat exchange tubes.

Notably, the lower end of the first header tank 3 is located below the lower end of the second header tank 4, and the heat exchange tubes 2A, which form the fourth and fifth heat exchange paths P4, P5 are brazed to a portion of the first header tank 3 located below the second header tank 4. The upper end of the second header tank 4 is located above the upper end of the first header tank 3.

The interior of the second header tank 4 is divided into an upper header section 32 and a lower header section 33 by an aluminum partition plate 31, which is provided at a height between the first heat exchange path P1 and the second heat exchange path P2. The interior of the third header tank 5 is divided into an upper header section 36, an intermediate header section 37, and a lower header section 38 by aluminum partition plates 34 and 35, which are provided at a height between the second heat exchange path P2 and the third heat exchange path P3 and a height between the fourth heat exchange path P4 and the fifth heat exchange path P5, respectively. A refrigerant inlet 39A is formed at the upper header section 32 of the second header tank 32 (at a portion of the second header tank 4 extending upward beyond the first header tank 3), and a refrigerant outlet 39B is formed at the lower header section 38 of the third header tank 5. A refrigerant inlet member 16 which communicates with the refrigerant inlet 39A is joined to the second header tank 4, and a refrigerant outlet member 17 which communicates with the refrigerant outlet 39B is joined to the third header tank 5.

Left end portions of the second heat exchange tubes 2B of the first heat exchange path P1 are connected to the upper header section 32 of the second header tank 4, and right end portions thereof are connected to the upper header section 36 of the third header tank 5. Left end portions of the second heat exchange tubes 2B of the second heat exchange path P2 are connected to the lower header section 33 of the second header tank 4, and right end portions thereof are connected to the upper header section 36 of the third header tank 5. Left end portions of the second heat exchange tubes 2B of the third heat exchange path P3 are connected to the lower header section 33 of the second header tank 4, and right end portions thereof are connected to the intermediate header section 37 of the third header tank 5. Left end portions of the first heat exchange tubes 2A of the fourth heat exchange path P4 are connected to the first header tank 3, and right end portions thereof are connected to the intermediate header section 37 of the third header tank 5. Left end portions of the first heat exchange tubes 2A of the fifth heat exchange path P5 are connected to the first header tank 3, and right end portions thereof are connected to the lower header section 38 of the third header tank 5. As a result, in the group G, refrigerant flows from the first heat exchange path P1 at the upper end toward the fourth heat exchange path P4 at the lower end, as described above.

The second header tank 4, a portion of the first header tank 3 to which the first heat exchange tubes 2A of the fourth heat exchange path P4 are connected, the upper header section 36 and the intermediate header section 37 of the third header tank 5, and the first through fourth heat exchange paths P1-P4 form a condensation section 30A, which condensates refrigerant. A portion of the first header tank 3 to which the first heat exchange tubes 2A of the fifth heat exchange path P5 are connected, the lower header section 38 of the third header tank 5, and the fifth heat exchange path P5 form a super-cooling section 30B, which super-cools refrigerant. The first through fourth heat exchange paths P1-P4 (all the heat exchange paths of the group G) each serve as a refrigerant condensation path for condensing refrigerant. The fifth heat exchange path P5 located below the group G serves as a refrigerant super-cooling path for super-cooling refrigerant.

A plurality of spacers 21, which are formed of aluminum and are spaced from each other in the vertical are disposed between a projecting portion 3*a* of the first header tank 3 which projects upward beyond the lower end of the second header tank 4 and the lower header section 33 of the second header tank 4; i.e., a portion of the second header tank 4 excluding a portion to which the second heat exchange tubes 2B of the first heat exchange path P1, which is the upstream-most heat exchange path of the group G, are connected. Each of the spacers 21 is composed of a first portion 22 which comes into contact with a portion of the outer circumferential surface of the first header tank 3 and is brazed to the first header tank 3, and two second portions 23 which are provided on upper and lower sides of the first portion 22, come into contact with portions of the outer circumferential surface of the second header tank 4, and are brazed to the second header tank 4. By means of the spacers 21, the width of the clearance 19 between the projecting portion 3*a* of the first header tank 3 and the second header tank 4 is maintained at a proper size which can suppress accumulation of a substance which accelerates corrosion. Preferably, the width W of the clearance 19 as measured in the left-right direction is 2 mm or greater.

The remaining structure is similar to that of the condenser shown in FIGS. 1 to 4.

In the condenser 30 shown in FIGS. 5 and 6, gas phase refrigerant of high temperature and high pressure compressed by the compressor flows into the upper header section 32 of the second header tank 4 via the refrigerant inlet member 16 and the refrigerant inlet 39A. The gas phase refrigerant is condensed while flowing rightward within the second heat exchange tubes 2B of the first heat exchange path P1, and then flows into the upper header section 36 of the third header tank 5. The refrigerant having flowed into the upper header section 36 of the third header tank 5 is condensed while flowing leftward within the second heat exchange tubes 2B of the second heat exchange path P2, and then flows into the lower header section 33 of the second header tank 4. The refrigerant having flowed into the lower header section 33 of the second header tank 4 is condensed while flowing rightward within the second exchange tubes 2B of the third heat exchange path P3, and then flows into the intermediate header section 37 of the third header tank 5. The refrigerant having flowed into the intermediate header section 37 of the third header tank 5 is condensed while flowing leftward within the first heat exchange tubes 2A of the fourth heat exchange path P4, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and enters the first heat exchange tubes 2A of the fifth heat exchange path P5. The liquid-predominant mixed phase refrigerant having entered the first heat exchange tubes 2A of the fifth heat exchange path P5 is super-cooled while flowing rightward within the first heat exchange tubes 2A. After that, the super-cooled refrigerant enters the lower header section 38 of the third header tank 5, and flows out via the refrigerant outlet 39B and the refrigerant outlet member 17. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 7:
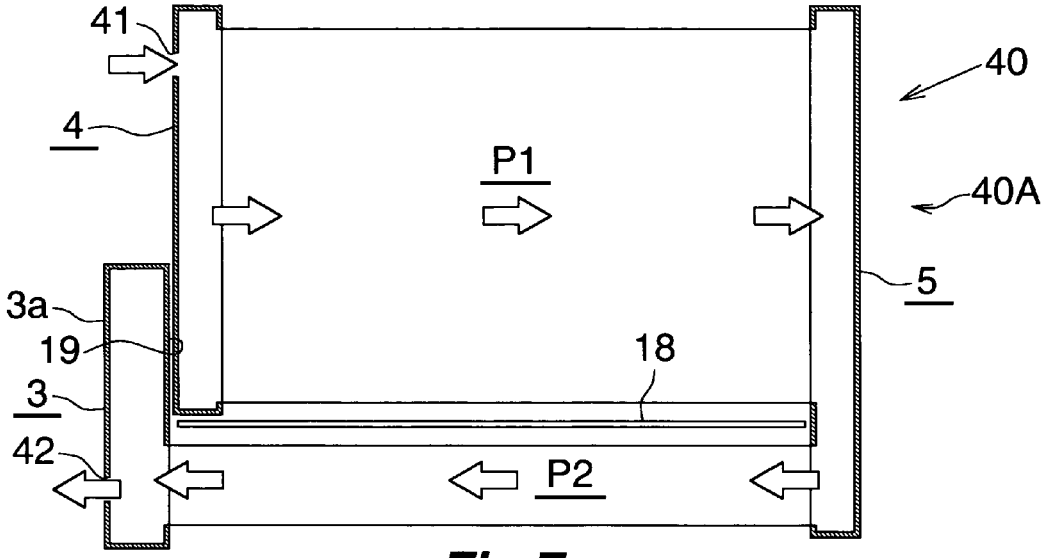
FIG. 7 is a front view schematically showing a third embodiment of the condenser according to the present invention.

FIG. 7 schematically shows a third embodiment of the condenser according to the present invention. In FIG. 7, the individual heat exchange tubes are omitted, and the corrugate fins, the side plates, the refrigerant inlet member, and the refrigerant outlet member are also omitted.

In the case of a condenser 40 shown in FIG. 7, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the upper side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Therefore, the heat exchange tubes 2A, which form the second heat exchange path P2, are the first heat exchange tubes, and the heat exchange tubes 2B, which form the first heat exchange path P1, are the second heat exchange tubes.

The first through third header tank 3-5, and the first and second heat exchange paths P1, P2 form a condensation section 40A, which condenses refrigerant. The first and second heat exchange paths P1, P2 (i.e., all the heat exchange paths) each serve as a refrigerant condensation path for condensing refrigerant.

A refrigerant inlet 41 is formed at an upper end portion of the second header tank 4, which partially forms the condensation section 40A, and a refrigerant outlet 42 is formed at a lower end portion of the first header tank 3. A refrigerant inlet member (not shown) which communicates with the refrigerant inlet 41 is joined to the second header tank 4, and a refrigerant outlet member (not shown) which communicates with the refrigerant outlet 42 is joined to the first header tank 3.

In the condenser 40 shown in FIG. 7, although not illustrated, a spacer 21 formed of aluminum is disposed between the projecting portion 3*a* of the first header tank 3 which projects upward beyond the lower end of the second header tank 4 and the second header tank 4. The spacer 21 is composed of a first portion 22 which comes into contact with a portion of the outer circumferential surface of the first header tank 3 and is brazed to the first header tank 3; and two second portions 23 which are provided on upper and lower sides of the first portion 22, come into contact with portions of the outer circumferential surface of the second header tank 4, and are brazed to the second header tank 4. By means of the spacer 21, the width of the clearance 19 between the projecting portion 3*a* of the first header tank 3 and the second header tank 4 is maintained at a proper size which can suppress accumulation of a substance which accelerates corrosion. Preferably, the width W of the clearance 19 as measured in the left-right direction is 2 mm or greater.

The remaining structure is similar to that of the condenser shown in FIGS. 1 to 4.

In the condenser 40 shown in FIG. 7, gas phase refrigerant of high temperature and high pressure compressed by the compressor flows into the second header tank 4 via the refrigerant inlet member and the refrigerant inlet 41. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3.

The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 42 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Figure 8:
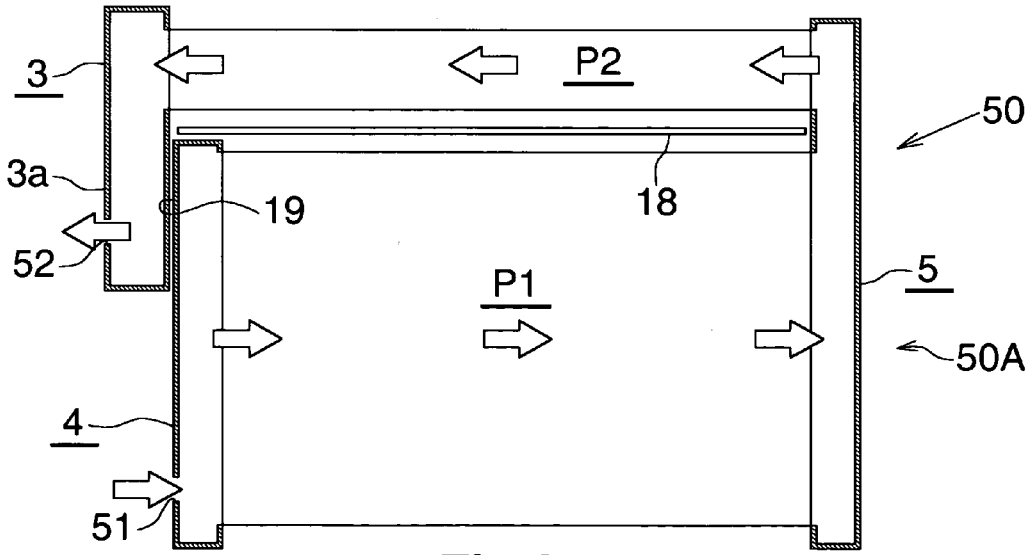
FIG. 8 is a front view schematically showing a fourth embodiment of the condenser according to the present invention.

FIG. 8 schematically shows a fourth embodiment of the condenser according to the present invention. In FIG. 8, the individual heat exchange tubes are omitted, and the corrugate fins, the side plates, the refrigerant inlet member, and the refrigerant outlet member are also omitted.

In the case of a condenser 50 shown in FIG. 8, two heat exchange paths P1, P2 each formed by a plurality of heat exchange tubes 2A, 2B successively arranged in the vertical direction are juxtaposed in the vertical direction. The two heat exchange paths will be referred to as the first and second heat exchange paths P1, P2 from the lower side. The flow direction of refrigerant is the same among all the heat exchange tubes 2A, 2B which form the respective heat exchange paths P1, P2. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

Left and right end portions of the heat exchange tubes 2B, which form the first heat exchange path P1, are connected to the second header tank 4 and the third header tank 5, respectively, by means of brazing. Left and right end portions of the heat exchange tubes 2A, which form the second heat exchange path P2, are connected to the first header tank 3 and the third header tank 5, respectively, by means of brazing. Therefore, the heat exchange tubes 2A, which form the second heat exchange path P2, are the first heat exchange tubes, and the heat exchange tubes 2B, which form the first heat exchange path P1, are the second heat exchange tubes.

The lower end of the first header tank 3, disposed leftward of the second header tank 4, is located below the upper end of the second header tank 4, and the first header tank 3 has a gas-liquid separation function.

The first through third header tank 3-5, and the first and second heat exchange paths P1, P2 form a condensation section 50A, which condenses refrigerant. The first and second heat exchange paths P1, P2 (i.e., all the heat exchange paths) each serve as a refrigerant condensation path for condensing refrigerant.

A refrigerant inlet 51 is formed at a lower end portion of the second header tank 4, which partially forms the condensation section 50A, and a refrigerant outlet 52 is formed at a lower end portion of the first header tank 3. A refrigerant inlet member (not shown) which communicates with the refrigerant inlet 51 is joined to the second header tank 4, and a refrigerant outlet member (not shown) which communicates with the refrigerant outlet 52 is joined to the first header tank 3.

In the condenser 50 shown in FIG. 8, although not illustrated, a spacer 21 formed of aluminum is disposed between the projecting portion 3*a* of the first header tank 3 which projects downward beyond the upper end of the second header tank 4 and the second header tank 4. The spacer 21 is composed of a first portion 22 which comes into contact with a portion of the outer circumferential surface of the first header tank 3 and is brazed to the first header tank 3, and two second portions 23 which are provided on upper and lower sides of the first portion 22, come into contact with portions of the outer circumferential surface of the second header tank 4, and are brazed to the second header tank 4. By means of the spacer 21, the width of the clearance 19 between the projecting portion 3*a* of the first header tank 3 and the second header tank 4 is maintained at a proper size which can suppress accumulation of a substance which accelerates corrosion. Preferably, the width W of the clearance 19 as measured in the left-right direction is 2 mm or greater.

The remaining structure is similar to that of the condenser shown in FIGS. 1 to 4.

In the condenser 50 shown in FIG. 8, gas phase refrigerant of high temperature and high pressure compressed by the compressor flows into the second header tank 4 via the refrigerant inlet member and the refrigerant inlet 51. The gas phase refrigerant is condensed while flowing rightward within the second heat exchange tubes 2B of the first heat exchange path P1, and then flows into the third header tank 5. The refrigerant having flowed into the third header tank 5 is condensed while flowing leftward within the first heat exchange tubes 2A of the second heat exchange path P2, and then flows into the first header tank 3. The refrigerant having flowed into the first header tank 3 is gas-liquid mixed phase refrigerant. A portion of the gas-liquid mixed phase refrigerant; i.e., liquid-predominant mixed phase refrigerant, remains in a lower region within the first header tank 3 because of gravitational force, and flows out via the refrigerant outlet 52 and the refrigerant outlet member. The refrigerant is then fed to the evaporator via the expansion valve.

Meanwhile, the gas phase component of the gas-liquid mixed phase refrigerant having flowed into the first header tank 3 remains in an upper region within the first header tank 3.

Notably, in the condensers 40, 50 shown in FIGS. 7 and 8, two or more heat exchange paths each formed by a plurality of second heat exchange tubes 2B successively arranged in the vertical direction may be juxtaposed in the vertical direction between the second header tank 4 and the third header tank 5. In the case where an even number of heat exchange paths are provided between the second header tank 4 and the third header tank 5, a refrigerant inlet is formed at a lower end portion of the third header tank 5, and a proper number of header sections are provided in each of the second header tank 4 and the third header tank 5. In the case where an odd number of heat exchange paths are provided between the second header tank 4 and the third header tank 5, a refrigerant inlet is formed at a lower end portion of the second header tank 4, and a proper number of header sections are provided in each of the second header tank 4 and the third header tank 5.

Notably, in each of the above-described condensers 1, 30, 40, 50, at least one of a desiccant, a gas liquid separation member, and a filter may be disposed in the first header tank 3.

What is claimed is:

1. A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which three or more heat exchange paths each formed by a plurality of heat exchange tubes successively arranged in the vertical direction are juxtaposed in the vertical direction, wherein the condenser has a group composed of at least two heat exchange paths which are successively arranged and which include a heat exchange path at an upper end, and at least one heat exchange path is provided below the group;

in the group, refrigerant is caused to flow from a heat exchange path at one of upper and lower ends toward a heat exchange path at the other end;

first and second header tanks are provided at a left or right end of the condenser, first heat exchange tubes which form a heat exchange path located on the downstream-most side of the group with respect to a refrigerant flow direction and first heat exchange tubes which form the heat exchange path located below the group being connected to the first header tank, and second heat exchange tubes which form all the remaining heat exchange path (s) being connected to the second header tank;

the first header tank is disposed on the outer side of the second header tank with respect to the left-right direction, has an upper end located above a lower end of the second header tank, and has a function of separating gas and liquid from each other and storing the liquid;

a spacer is disposed between the second header tank and a portion of the first header tank projecting upward beyond the lower end of the second header tank; and the spacer includes a first portion which comes into contact with a portion of an outer circumferential surface of the first header tank and is brazed to the first header tank, and a second portion which comes into contact with a portion of an outer circumferential surface of the second header tank and is brazed to the second header tank, wherein in the group, refrigerant is caused to flow from a heat exchange path at the upper end toward a heat exchange path at the lower end; a lower end of the first header tank is located below the lower end of the second header tank; and the first heat exchange tubes which form the lower end heat exchange path of the group and the heat exchange path provided below the group are connected to a portion of the first header tank located below the second header tank.

2. A condenser according to claim 1, wherein all the heat exchange paths of the group are refrigerant condensation paths for condensing refrigerant, and the heat exchange path located below the group is a refrigerant supper-cooling path for supper-cooling refrigerant.

3. A condenser according to claim 1, wherein the spacer is disposed between the first header tank and a portion of the second header tank excluding a portion to which the second heat exchange tubes of the upstreammost heat exchange path of the group are connected.

4. A condenser according to claim 1, wherein the first heat exchange tubes which form at least two heat exchange paths are connected to the first header tank, and the second heat exchange tubes which form at least one heat exchange path are connected to the second header tank.

5. A condenser according to claim 1, wherein a clearance between the second header tank and a portion of the first header tank projecting beyond the second header tank has a width of 2 mm or greater.

* * * * *